US006504295B1

(12) United States Patent
Chang

(10) Patent No.: US 6,504,295 B1
(45) Date of Patent: Jan. 7, 2003

(54) DEFLECTION DEVICE OF DISPLAYER

(75) Inventor: Kyung Soo Chang, Kyungki-Do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 09/221,413

(22) Filed: Dec. 28, 1998

(30) Foreign Application Priority Data

| | | |
|---|---|---|
| May 4, 1998 | (KR) | 98-16593 |
| May 4, 1998 | (KR) | 98-16594 |
| May 4, 1998 | (KR) | 98-16595 |
| Sep. 30, 1998 | (KR) | 98-18728 |
| Sep. 30, 1998 | (KR) | 98-18729 |
| Sep. 30, 1998 | (KR) | 98-40788 |

(51) Int. Cl.[7] ..... H01J 29/70
(52) U.S. Cl. ..... 313/440; 335/210; 335/213
(58) Field of Search ..... 313/440, 437, 313/428; 335/210, 213, 296

(56) References Cited

U.S. PATENT DOCUMENTS

| | | | | |
|---|---|---|---|---|
| 3,582,848 A | | 6/1971 | Ryder et al. | 335/212 |
| 5,780,963 A | * | 7/1998 | Matsuoka et al. | 313/440 |
| 5,844,353 A | * | 12/1998 | Nam | 335/210 |
| 5,869,923 A | * | 2/1999 | Strzelichowski et al. | 313/440 |
| 5,945,779 A | * | 8/1999 | Ionue et al. | 335/210 X |

* cited by examiner

*Primary Examiner*—Ashok Patel
(74) *Attorney, Agent, or Firm*—Ladas & Parry

(57) ABSTRACT

A display device is disclosed. A cathode ray tube has a screen on which a fluorescent layer is applied and an electron gun section in which electron guns are mounted. A deflection yoke includes a coil separator, and horizontal and vertical deflecting coils which are disposed on circumferential inner and outer surfaces of the coil separator, respectively. The coil separator has a neck part which is fitted around the electron gun section of the cathode ray tube. A first locking section is arranged on a circumferential outer surface of the neck part of the coil separator. A clamping mechanism is fitted around the neck part of the coil separator. The clamping mechanism has a second locking section. The second locking section has a closed-loop shaped configuration which surrounds the circumferential outer surface of the neck part. The second locking section cooperates with the first locking section for locking the deflection yoke to the electron gun section of the cathode ray tube.

23 Claims, 17 Drawing Sheets

DEFLECTION DEVICE OF DISPLAYER

BACKGROUND OF THE INVENTION

1. Field of the Invention

The present invention relates to a display device for displaying a picture, and more particularly, the present invention relates to a deflection yoke and a convergence yoke which are mounted to an electron gun section of a cathode ray tube (CRT) for deflecting electron beams emitted from electron guns and performing a positive convergence adjustment of the electron beams, respectively.

2. Description of the Prior Art

Referring to FIGS. 1 and 2, there is illustrated a television receiver which is most widely used as a displayer.

The television receiver includes a cathode ray tube 1, deflecting means, and clamping means. The cathode ray tube 1 is made of glass. A screen 2 on which a fluorescent layer (not shown) is applied is disposed at a front portion of the cathode ray tube 1, and a neck 4 in which electron guns 3 are mounted is disposed on a rear portion of the cathode ray tube 1.

The neck 4 of the cathode ray tube 1 is provided with the deflecting means which precisely focuses electron beams emitted from the electron guns 3 onto the fluorescent layer applied on the screen 2.

The deflecting means includes a deflection yoke 5 fitted around the neck 4, and a convergence yoke 6 fitted around the neck 4 at the rear of the deflection yoke 5.

The deflection yoke 5 functions to horizontally and vertically deflect the electron beams emitted from the electron guns 3 by horizontal and vertical deflecting coils which are wound around circumferential inner and outer surfaces thereof, respectively, and precisely focus the electron beams onto the fluorescent layer applied on the screen 2 to reproduce a picture.

The convergence yoke 6 functions to perform a positive convergence adjustment for precisely focusing the electron beams emitted from the electron guns 3 onto a center of the screen 2.

In the meanwhile, the deflecting means, that is, the deflection yoke 5 and the convergence yoke 6 must be maintained in a securely clamped state onto the neck 4 of the cathode ray tube 1.

For this reason, a yoke clamp 7 as shown in FIGS. 1 and 2, is provided as a means for clamping the deflection yoke 5 and the convergence yoke 6 onto the neck 4 of the cathode ray tube 1.

In other words, the deflection yoke 5 and the convergence yoke 6 which constitute the deflecting means are formed with neck parts 5*a* and 6*a*, respectively. The neck parts 5*a* and 6*a* are fitted around the neck 4 of the cathode ray tube 1. By fastening the yoke clamp 7 around the neck parts 5*a* and 6*a* by the fastening screw S, the deflection yoke 5 and the convergence yoke 6 are clamped to the neck 4 of the cathode ray tube 1.

However, in the deflection device of the prior art, constructed as mentioned above, in the process of clamping the deflection yoke 5 and the convergence yoke 6 constituting the deflecting means by the clamping means, that is, the yoke clamp 7, a thread of the fastening screw S may be worn out, whereby a stable clamping cannot be ensured.

Also, in the process of clamping the deflection yoke 5 and the convergence yoke 6 to the neck 4 of the cathode ray tube 1 by the fastening screw S and the yoke clamp 7, a load may be concentrated onto a portion of the neck 4 of the cathode ray tube 1, and therefore, the cathode ray tube 1 made of glass is apt to be broken.

Moreover, a separate clamping tool is necessary to fasten the yoke clamp 7 around the deflection yoke 5 and the convergence yoke 6 by the fastening screw S, and specifically, in the course of locking the fastening screw S into the yoke clamp 7, it is difficult to achieve a uniform locking.

Accordingly, due to the fact that the deflecting means is easily moved by an outside shock, deflections of the electron beams are not precisely performed, and as a result, quality of a picture is deteriorated, whereby reliability of an end product is diminished.

SUMMARY OF THE INVENTION

Accordingly, the present invention has been made in an effort to solve the problems occurring in the prior art, and a primary object of the present invention is to provide a display device in which a deflection yoke is stably clamped to an electron gun section of a cathode ray tube to precisely deflect electron beams toward a fluorescent layer.

Another object of the present invention is to provide a display device in which a convergence yoke is stably clamped to an electron gun section of a cathode ray tube to precisely perform a positive convergence adjustment of electron beams.

Still another object of the present invention is to provide the deflection yoke which is stably clamped to the electron gun section of the cathode ray tube to precisely deflect electron beams toward the fluorescent layer.

Yet still another object of the present invention is to provide a convergence yoke which is stably clamped to the electron gun section of the cathode ray tube to precisely perform the positive convergence adjustment of electron beams.

According to one aspect of the present invention, there is provided a display device comprising: a cathode ray tube having a screen on which a fluorescent layer is applied and an electron gun section in which electron guns are mounted; a deflection yoke including a coil separator having a neck part which is fitted around the electron gun section of the cathode ray tube, and horizontal and vertical deflecting coils which are disposed on circumferential inner and outer surfaces of the coil separator, respectively; first locking means arranged on the neck part of the coil separator; and clamping means fitted around the neck part of the coil separator and having second locking means, the second locking means cooperating with the first locking means for locking the deflection yoke to the electron gun section of the cathode ray tube.

According to another aspect of the present invention, there is provided a display device comprising: a cathode ray tube having a screen on which a fluorescent layer is applied and an electron gun section in which electron guns are mounted; a convergence yoke having a cylindrical body which is fitted around the electron gun section of the cathode ray tube, and a plurality of pole pieces arranged on a circumferential outer surface of the cylindrical body such that two adjoining pole pieces are spaced from each other by a predetermined distance; first locking means arranged on the cylindrical body of the convergence yoke; and clamping means having second locking means, the second locking means cooperating with the first locking means for locking the convergence yoke to the electron gun section of the cathode ray tube.

According to still another aspect of the present invention, there is provided a deflection yoke coupled to an electron gun section of a cathode ray tube having a screen on which a fluorescent layer is applied, for deflecting electron beams emitted from electron guns mounted in the electron gun section toward the fluorescent layer of the screen, the deflection yoke comprising: a coil separator having a neck part which is fitted around the electron gun section of the cathode ray tube and has first locking means arranged on a circumferential outer surface thereof; a horizontal deflecting coil disposed on a circumferential inner surface of the coil separator for forming a horizontally deflecting magnetic field; a vertical deflecting coil disposed together with a ferrite core on a circumferential outer surface of the coil separator for forming a vertically deflecting magnetic field; and clamping means fitted around the neck part of the coil separator and having second locking means, the second locking means cooperating with the first locking means for locking the coil separator to the electron gun section of the cathode ray tube.

According to yet still another aspect of the present invention, there is provided a convergence yoke coupled to an electron gun section of a cathode ray tube having a screen on which a fluorescent layer is applied, for performing a positive convergence adjustment to focus electron beams emitted from electron guns mounted in the electron gun section toward a center of the screen, the convergence yoke comprising: a cylindrical body fitted around the electron gun section of the cathode ray tube and having first locking means arranged on a circumferential outer surface thereof; a plurality of pole pieces arranged on the circumferential outer surface of the cylindrical body such that two adjoining pole pieces are spaced from each other by a predetermined distance; and clamping means having second locking means, the second locking means cooperating with the first locking means for locking the cylindrical body to the electron gun section of the cathode ray tube.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
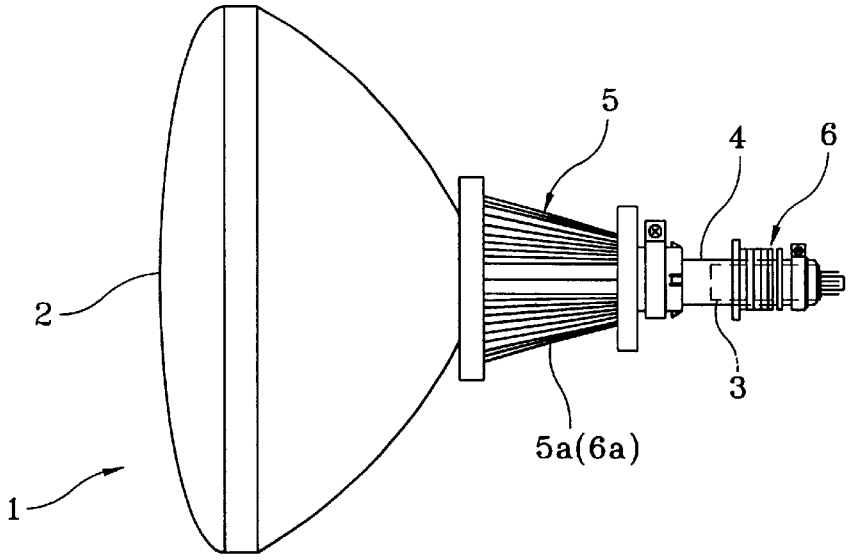
FIG. 1 is a schematic side view illustrating a deflecting device of a displayer according to the prior art.
Figure 2:
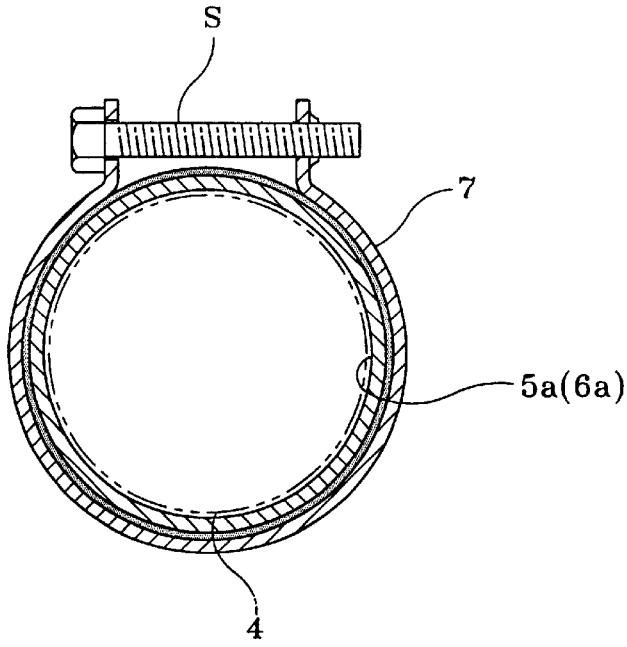
FIG. 2 is a cross-sectional view illustrating main components of the deflecting device of FIG. 1.
Figure 3:
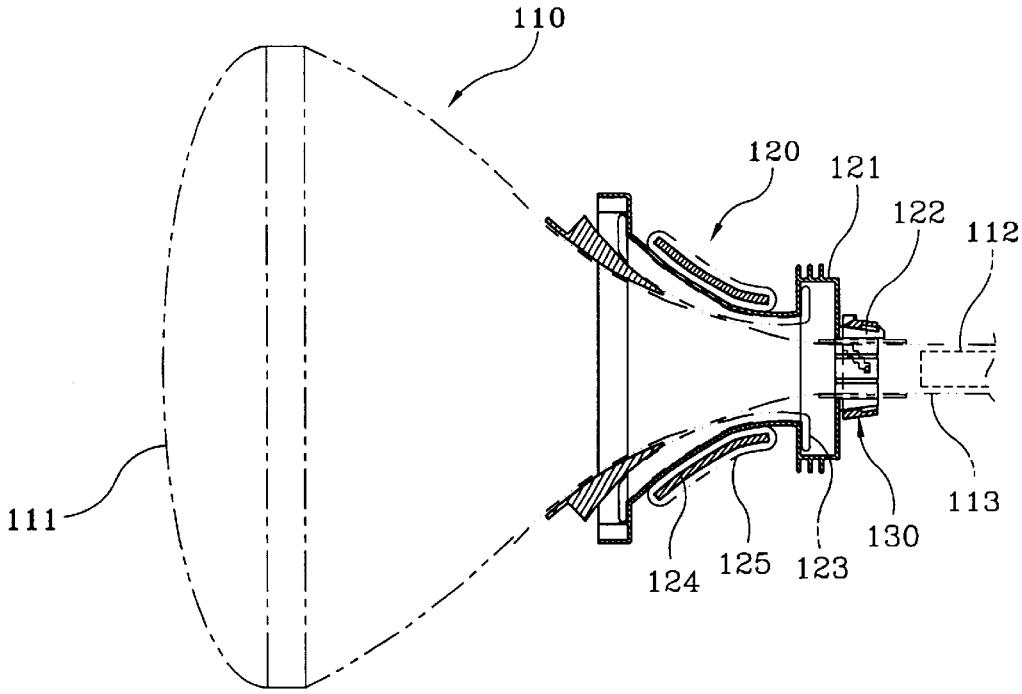
FIG. 3 is a side view of a display device in accordance with an embodiment of the present invention.
Figure 4:
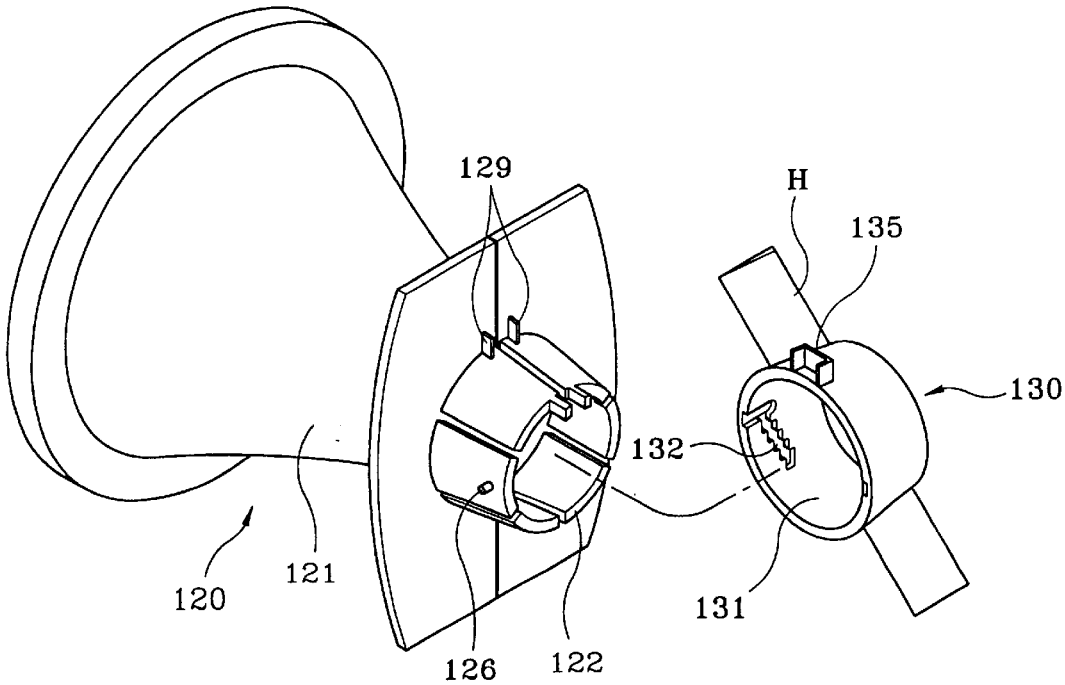
FIGS. 4 through 6 are perspective views illustrating various embodiments of first and second locking means of the display device of FIG. 3.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIGS. 3 through 8, a display device according to the present invention includes a cathode ray tube 110. The cathode ray tube 110 has a screen 111 on which a fluorescent layer is applied, and an electron gun section 113 in which electron guns 112 are mounted.

A deflection yoke 120 is clamped to the electron gun section 113 of the cathode ray tube 110, according to the present invention. The deflection yoke 120 includes a coil separator 121 which has a neck part 122. The neck part 122 is fitted around the electron gun section 113 of the cathode ray tube 110 and has first locking means arranged on a circumferential outer surface thereof.

A horizontal deflecting coil 123 is disposed on a circumferential inner surface of the coil separator 121 to form a horizontally deflecting magnetic field, and a vertical deflecting coil 125 is disposed together with a ferrite core 124 on a circumferential outer surface of the coil separator 121 to form a vertically deflecting magnetic field.

Clamping means 130 is fitted around the neck part 122 of the coil separator 121. The clamping means 130 has second locking means which cooperates with the first locking means to clamp the deflection yoke 120 to the electron gun section 113 of the cathode ray tube 110.

The second locking means of the clamping means 130 has a closed-loop shaped configuration which surrounds the circumferential outer surface of the neck part 122 having the first locking means.

The first and second locking means are locked with each other while being rotated about an axis which is perpendicular to a plane of the screen 111 of the cathode ray tube 110.

As the first locking means, a guide projection 126 is projectedly formed on the circumferential outer surface of the neck part 122. The guide projection 126 has a predetermined length.

As the second locking means, a squeezing surface 131 is defined in a circumferential inner surface of the clamping means 130. The squeezing surface 131 has a diameter which is not greater than an outer diameter of the neck part 122 of the coil separator 121. Also, as the second locking means, a guide rail 132 is formed in the squeezing surface 131 such that it extends slantingly within a predetermined range in a direction in which the clamping means 130 is fitted around the neck part 122 of the coil separator 121.

When viewing a shape of the guide rail 132, the guide rail 132 has a plurality of inclined surfaces 132*a* on which the guide projection 126 constituting the first locking means can be guided while sliding thereon, and a plurality of depressions 132*b* each of which is defined between two adjoining inclined surfaces 132*a* and into which the guide projection 126 can be selectively engaged.

Figure 5:
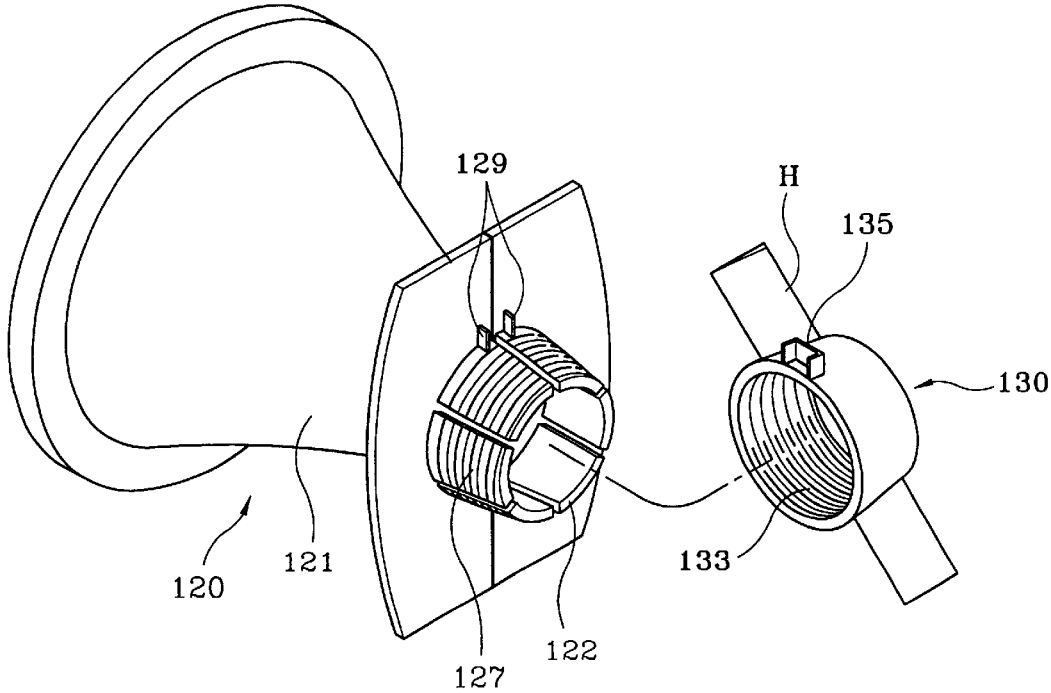

On the other hand, as shown in FIG. 5, an externally threaded portion 127 formed on the circumferential outer surface of the neck part 122 of the coil separator 121 can be used as the first locking means.

According to this, the second locking means consists of the squeezing surface 131 defined in the circumferential inner surface of the clamping means 130 and having the diameter which is not greater than the outer diameter of the neck part 122 of the coil separator 121, and an internally threaded portion 133 formed on the squeezing surface 131.

Figure 6:
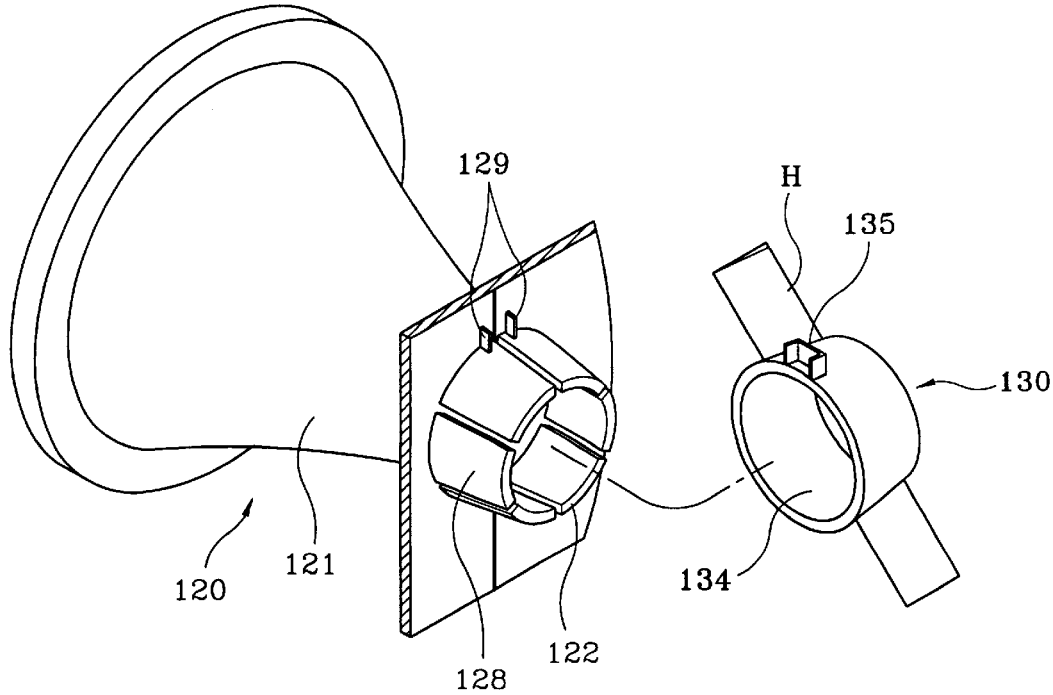
Figure 7:
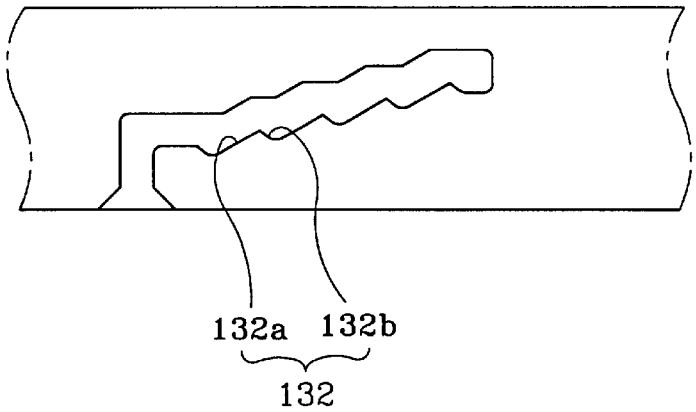
FIG. 7 is an enlarged view of clamping means which uses a guide rail as the second locking means.

Referring to FIG. 6, as the first locking means, a first tapered surface 128 can be formed on the circumferential outer surface of the neck part 122 of the coil separator 121. The first tapered surface 128 is tapered in an axial direction, and has a predetermined taper. Also, as the second locking means, a second tapered surface 134 can be formed on the circumferential inner surface of the clamping means 130. The second tapered surface 134 has a diameter which is not greater than the outer diameter of the neck part 122 of the coil separator 121.

In the meanwhile, once the deflection yoke 120 is clamped to the electron gun section 113 of the cathode ray tube 110 by the clamping means 130, it is preferred that a position of the deflection yoke 120 not be changed by an outside shock.

For this, it is desirable that a pair of brackets 129 are provided at a front end of the neck part 122 of the coil separator 121 constituting the deflection yoke 120 such that they are protruded in a radial direction from the circumferential outer surface of the neck part 122, and that a cover member 135 is provided at a front end of the clamping means 130. The pair of brackets 129 and the cover member 135 cooperate with each other for defining an adhesive receiving space therebetween when clamping of the deflection yoke 120 by the clamping means 130 is completed. Then, adhesive is introduced into the adhesive receiving space to increase a clamping force.

At this time, although it is explained that only the pair of brackets 129 and the cover member 135 are provided, it is preferred that at least two pairs of brackets and at least two cover members are provided to enhance the clamping force.

Also, as the clamping means 130 is fitted around the neck part 122 of the coil separator 121 while being rotated, a handle H is secured to the circumferential outer surface of the clamping means 130 to ease the rotation of the clamping means 130.

Hereinafter, clamping operations of the display device constructed as mentioned above, for clamping the deflection yoke 120 to the electron gun section 113 of the cathode ray tube 110, will be described in detail.

First, the neck part 122 of the coil separator 121 constituting the deflection yoke 120 is fitted around the electron gun section 113 of the cathode ray tube 110. Then, the clamping means 130 is fitted around the neck part 122 of the coil separator 121.

Figure 8A:
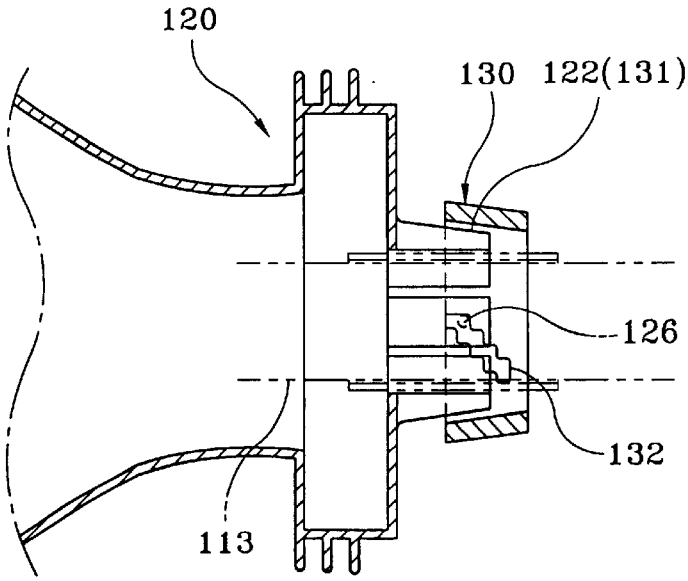
FIGS. 8*a* through 8*c* are cross-sectional views illustrating clamping operations when a guide projection and the guide rail are used as the first and second locking means, respectively, in the display device of FIG. 3.

At this time, as can be seen from FIG. 8*a*, even if the clamping means 130 is fitted around the neck part 122 of the coil separator 121, the deflection yoke 120 may be rotated or moved on a circumferential outer surface of the electron gun section 113 of the cathode ray tube 110.

Figure 8B:
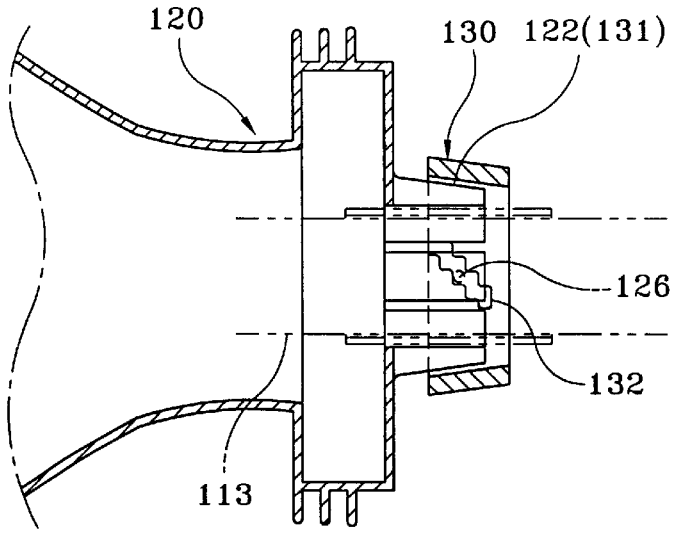

In this state, by rotating the clamping means 130 in a clockwise direction or a counter-clockwise direction while grasping the handle H secured to the circumferential outer surface of the clamping means 130, the second locking means arranged on the circumferential inner surface of the clamping means 130 cooperates with the first locking means arranged on the neck part 122 of the coil separator 121, and the clamping means 130 is moved toward the cathode ray tube 110 by a certain distance while squeezing the neck part 122 of the coil separator 121 against the electron gun section 113 of the cathode ray tube 110, to decrease the diameter of the neck part 122 to some extent, as shown in FIG. 8*b*.

In other words, in one embodiment of the present invention, the guide projection 126 constituting the first locking means is moved by a certain distance along the plurality of inclined surfaces 132*a*. In another embodiment of the present invention, the internally threaded portion 133 formed on the circumferential inner surface of the clamping means 130 and constituting the second locking means is moved by a certain distance along the externally threaded portion 127 formed on the neck part 122 of the coil separator 121 and constituting the first locking means.

Also, in still another embodiment of the present invention, the second tapered surface 134 formed on the circumferential inner surface of the clamping means 130 and constituting the second locking means is moved by a certain distance along the first tapered surface 128 formed on the circumferential outer surface of the neck part 122 of the coil separator 121 and constituting the first locking means.

In this state, the deflection yoke 120 is maintained in a pre-squeezed condition in which it can still be rotated or moved on the electron gun section 113 of the cathode ray tube 110 by applying a slight force.

Accordingly, it is possible to stably adjust deflections of the electron beams.

Figure 8C:
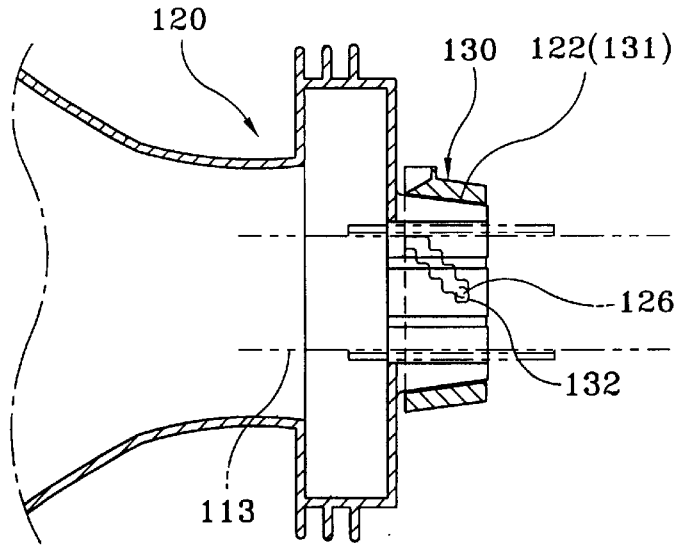
Figure 9:
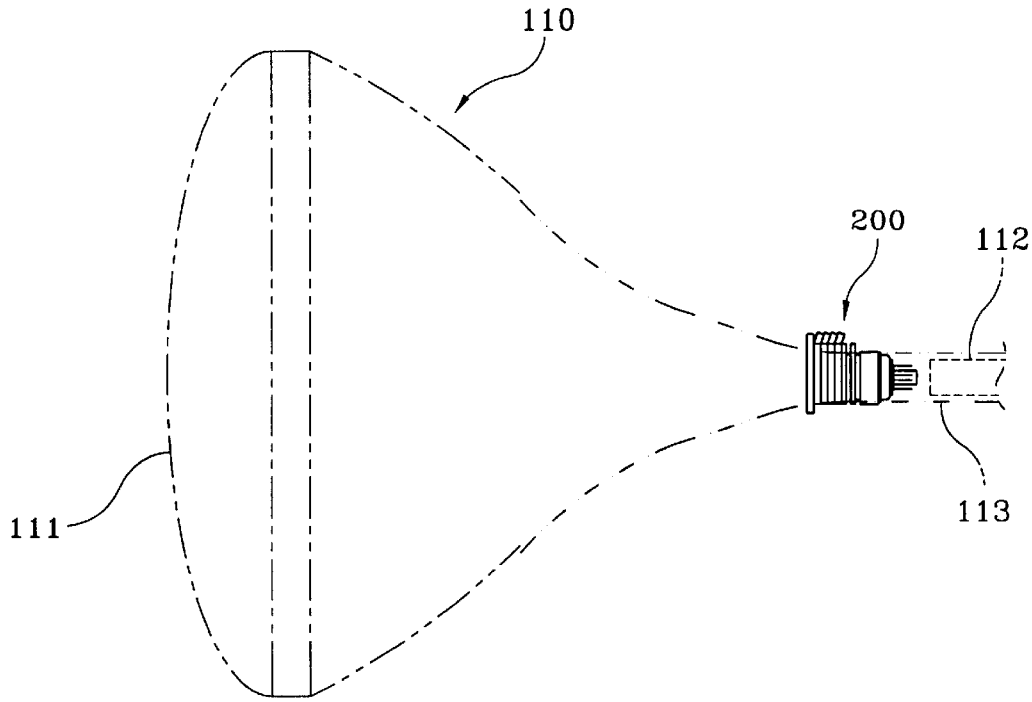
FIG. 9 is a side view of a display device in accordance with another embodiment of the present invention.
Figure 10:
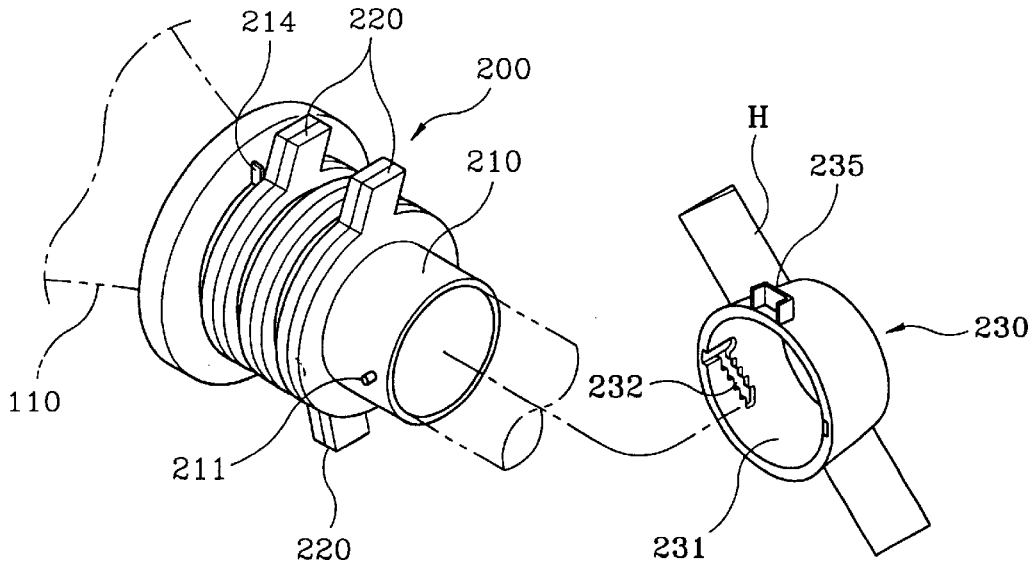
FIGS. 10 through 12 are perspective views illustrating various embodiments of first and second locking means of the display device of FIG. 9.

After the deflections of the electron beams are stably adjusted, if the clamping means 130 is further rotated, as best shown in FIG. 8*c*, the clamping means 130 is further moved toward the screen 111 of the cathode ray tube 110, and the second locking means provided to the clamping means 130 squeezes the neck part 122 of the coil separator 121 against the electron gun section 113 of the cathode ray tube 110, whereby the deflection yoke 120 is securely clamped to the electron gun section 113 of the cathode ray tube 110.

Also, at this time, the pair of brackets 129 secured to the front end of the neck part 122 of the coil separator 121 and the cover member 135 secured to the front end of the clamping means 130 are mated with each other to define the adhesive receiving space.

Accordingly, by introducing adhesive into the adhesive receiving space, the clamping force for clamping the deflection yoke 120 to the electron gun section 113 of the cathode ray tube 110 is elevated. Therefore, the position of the deflection yoke 120 is not changed by the outside shock.

As described above, according to the present invention, a deflection yoke for deflecting electron beams emitted from electron guns toward a screen of a cathode ray tube can be securely and stably clamped to an electron gun section of the cathode ray tube by a clamping means.

Hence, deterioration of a picture can be prevented due to stable deflections of electron beams, and reliability of a display device can be improved.

Also, since a screw or a special tool for fixing a deflection yoke is not required, the number of working operations is reduced, and since the deflection yoke is clamped through rotation of a clamping means, working efficiency is enhanced.

Hereinafter, another embodiment of the present invention will be described with reference to FIGS. 9 through 14.

A display device according to the present embodiment includes a cathode ray tube 110. The cathode ray tube 110 has a screen 111 on which a fluorescent layer is applied, and an electron gun section 113 in which electron guns 112 are mounted.

A convergence yoke 200 is clamped to the electron gun section 113 of the cathode ray tube 110, according to the present invention. The convergence yoke 200 includes a cylindrical body 210 fitted around the electron gun section 113 of the cathode ray tube 110 and having first locking means, and a plurality of pole pieces 220 arranged on a circumferential outer surface of the cylindrical body 210 such that two adjoining pole pieces 220 are spaced from each other by a predetermined distance.

The first locking means is defined on the circumferential outer surface of the cylindrical body 210 of the convergence yoke 200.

Clamping means 230 is fitted around the circumferential outer surface of the cylindrical body 210. The clamping means 230 has second locking means which cooperates with the first locking means to clamp the convergence yoke 200 to the electron gun section 113 of the cathode ray tube 110.

The second locking means of the clamping means 230 has a closed-loop shaped configuration which surrounds the circumferential outer surface of the cylindrical body 210 having the first locking means.

The first and second locking means are locked with each other while being rotated about an axis which is perpendicular to a plane of the screen 111 of the cathode ray tube 110.

As the first locking means, a guide projection 211 is projectedly formed on the circumferential outer surface of the cylindrical body 210 of the convergence yoke 200. The guide projection 211 has a predetermined length.

As the second locking means, a squeezing surface 231 is defined in a circumferential inner surface of the clamping means 230. The squeezing surface 231 has a diameter which is not greater than an outer diameter of the cylindrical body 210. Also, as the second locking means, a guide rail 232 is formed in the squeezing surface 231 such that it extends slantingly within a predetermined range in a direction in which the clamping means 230 is fitted around the cylindrical body 210.

Figure 13:
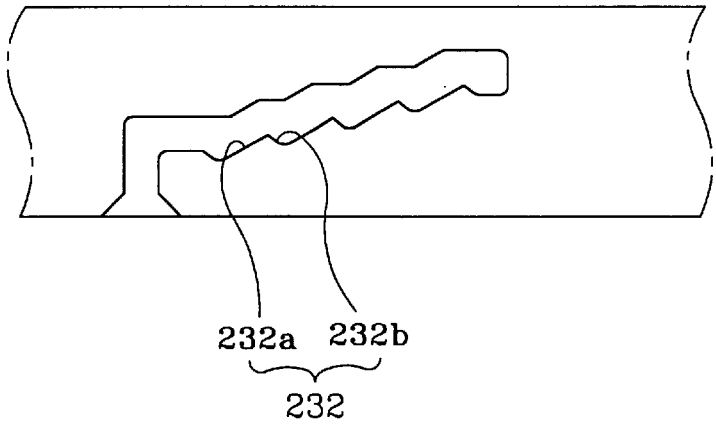
FIG. 13 is an enlarged view of clamping means which uses a guide rail as the second locking means.

When viewing a shape of the guide rail 232, as shown in FIG. 13, the guide rail 232 has a plurality of inclined surfaces 232*a* on which the guide projection 211 constituting the first locking means can be guided while sliding thereon, and a plurality of depressions 232*b* each of which is defined between two adjoining inclined surfaces 232*a* and into which the guide projection 211 can be selectively engaged.

Figure 11:
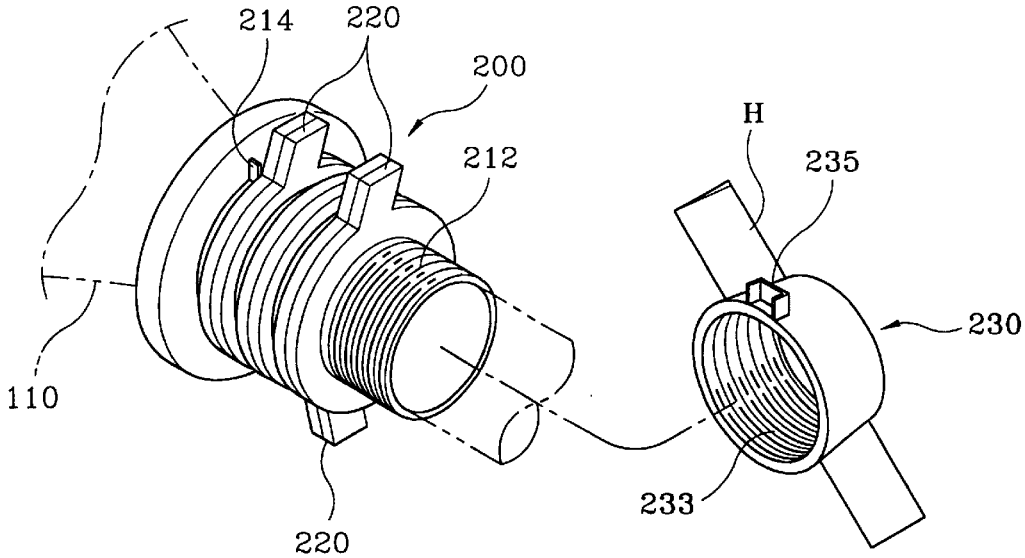

On the other hand, as shown in FIG. 11, an externally threaded portion 212 formed on the circumferential outer surface of the cylindrical body 210 can be used as the first locking means.

According to this, the second locking means consists of the squeezing surface 231 defined in the circumferential inner surface of the clamping means 230 and having the diameter which is not greater than the outer diameter of the cylindrical body 210, and an internally threaded portion 233 formed on the squeezing surface 231.

Figure 12:
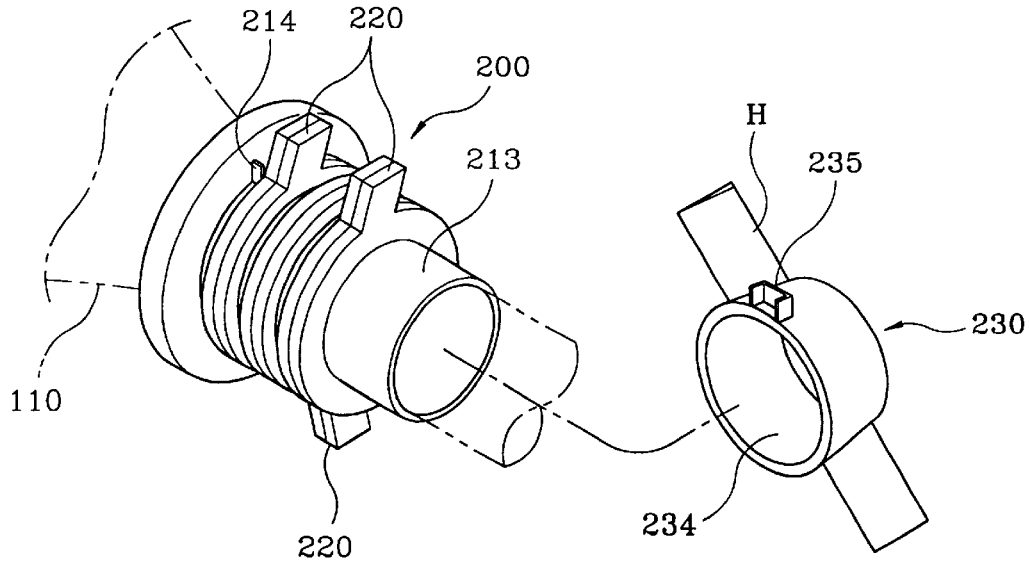

Referring to FIG. 12, as the first locking means, a first tapered surface 213 can be formed on the circumferential outer surface of cylindrical body 210. The first tapered surface 213 is tapered in an axial direction, and has a predetermined taper. Also, as the second locking means, a second tapered surface 234 can be formed on the circumferential inner surface of the clamping means 230. The second tapered surface 234 has a diameter which is not greater than the outer diameter of the cylindrical body 210.

In the meanwhile, once the convergence yoke 200 is clamped to the electron gun section 113 of the cathode ray tube 110 by the clamping means 230, it is preferred that a position of the convergence yoke 200 not be changed by an outside shock.

For this, it is desirable that a pair of brackets 214 are provided at a front end of the cylindrical body 210 constituting the convergence yoke 200 such that they are protruded in a radial direction from the circumferential outer surface of the cylindrical body 210, and that a cover member 235 is provided at a front end of the clamping means 230. The pair of brackets 214 and the cover member 235 cooperate with each other for defining an adhesive receiving space therebetween when clamping of the convergence yoke 200 by the clamping means 230 is completed. Then, adhesive is introduced into the adhesive receiving space to increase a clamping force.

At this time, although it is explained that only the pair of brackets 214 and the cover member 235 are provided, it is preferred that at least two pairs of brackets and at least two cover members are provided to enhance the clamping force.

Also, as the clamping means 230 is fitted around the cylindrical body 210 while being rotated, a handle H is secured to the circumferential outer surface of the clamping means 230 to ease the rotation of the clamping means 230.

Hereinafter, clamping operations of the display device constructed as mentioned above, for clamping the convergence yoke 200 to the electron gun section 113 of the cathode ray tube 110, will be described in detail.

First, the cylindrical body 210 constituting the convergence yoke 200 is fitted around the electron gun section 113 of the cathode ray tube 110. Then, the clamping means 230 is fitted around the cylindrical body 210.

Figure 14A:
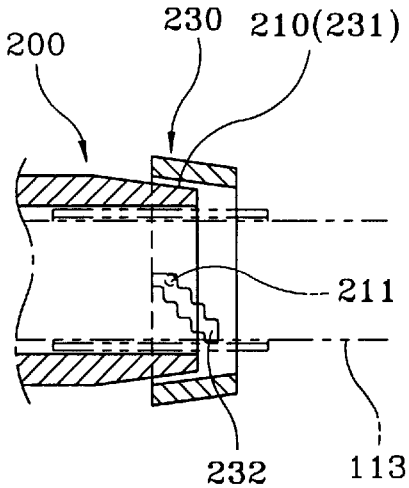
FIGS. 14*a* through 14*c* are cross-sectional views illustrating clamping operations when a guide projection and the guide rail are used as the first and second locking means, respectively, in the display device of FIG. 9.

At this time, as can be seen from FIG. 14*a*, even if the clamping means 230 is fitted around the cylindrical body 210, the convergence yoke 200 may be rotated or moved on a circumferential outer surface of the electron gun section 113 of the cathode ray tube 110.

Figure 14B:
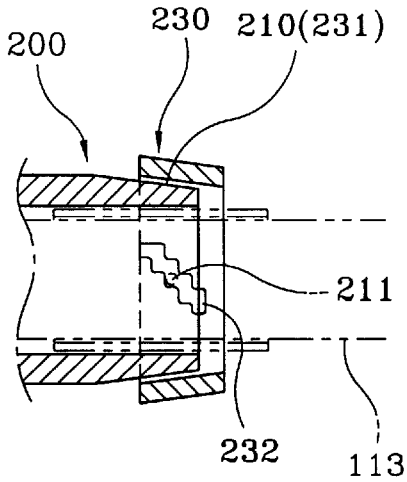

In this state, by rotating the clamping means 230 in a clockwise direction or a counter-clockwise direction while grasping the handle H secured to the circumferential outer surface of the clamping means 230, the second locking means arranged on the circumferential inner surface of the clamping means 230 cooperates with the first locking means arranged on the cylindrical body 210, and the clamping means 230 is moved toward the cathode ray tube 110 by a certain distance while squeezing the cylindrical body 210 against the electron gun section 113 of the cathode ray tube 110, to decrease the diameter of the cylindrical body 210 to some extent, as shown in FIG. 14*b*.

In other words, in one embodiment of the present invention, the guide projection 211 constituting the first locking means is moved by a certain distance along the plurality of inclined surfaces 232*a* of the guide rail 232. In another embodiment of the present invention, the internally threaded portion 233 formed on the circumferential inner surface of the clamping means 230 and constituting the second locking means is moved by a certain distance along the externally threaded portion 212 formed on the circumferential outer surface of the cylindrical body 210 and constituting the first locking means.

Also, in still another embodiment of the present invention, the second tapered surface 234 formed on the circumferential inner surface of the clamping means 230 and constituting the second locking means is moved by a certain distance along the first tapered surface 213 formed on the circumferential outer surface of the cylindrical body 210 and constituting the first locking means.

In this state, the convergence yoke 200 is maintained in a pre-squeezed condition in which it can still be rotated or moved on the electron gun section 113 of the cathode ray tube 110 by applying a slight force.

Accordingly, it is possible to stably adjust deflections of the electron beams.

Figure 14C:
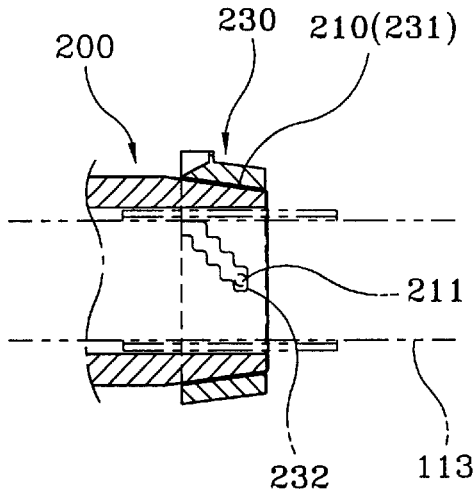

After the deflections of the electron beams are stably adjusted, if the clamping means 230 is further rotated, as best shown in FIG. 14*c*, the clamping means 230 is further moved toward the screen 111 of the cathode ray tube 110, and the second locking means provided to the clamping means 230 squeezes the cylindrical body 210 against the electron gun section 113 of the cathode ray tube 110, whereby the convergence yoke 200 is securely clamped to the electron gun section 113 of the cathode ray tube 110.

Also, at this time, the pair of brackets 214 secured to the front end of the cylindrical body 210 and the cover member 235 secured to the front end of the clamping means 230 are mated with each other to define the adhesive receiving space.

Accordingly, by introducing adhesive into the adhesive receiving space, the clamping force for clamping the convergence yoke 200 to the electron gun section 113 of the cathode ray tube 110 is elevated. Therefore, the position of the convergence yoke 200 is not changed by the outside shock.

As described above, according to the present invention, a convergence yoke for performing a positive convergence adjustment of electron beams emitted from electron guns can be securely and stably clamped to an electron gun section of a cathode ray tube by a clamping means.

Hence, deterioration of a picture can be prevented, and reliability of a display device can be improved.

Also, since a screw or a special tool for fixing a convergence yoke is not required, the number of working operations is reduced, and since the convergence yoke is clamped through rotation of a clamping means, working efficiency is enhanced.

Still another embodiment of the present invention will be described with reference to FIGS. 15 through 20.

Figure 15:
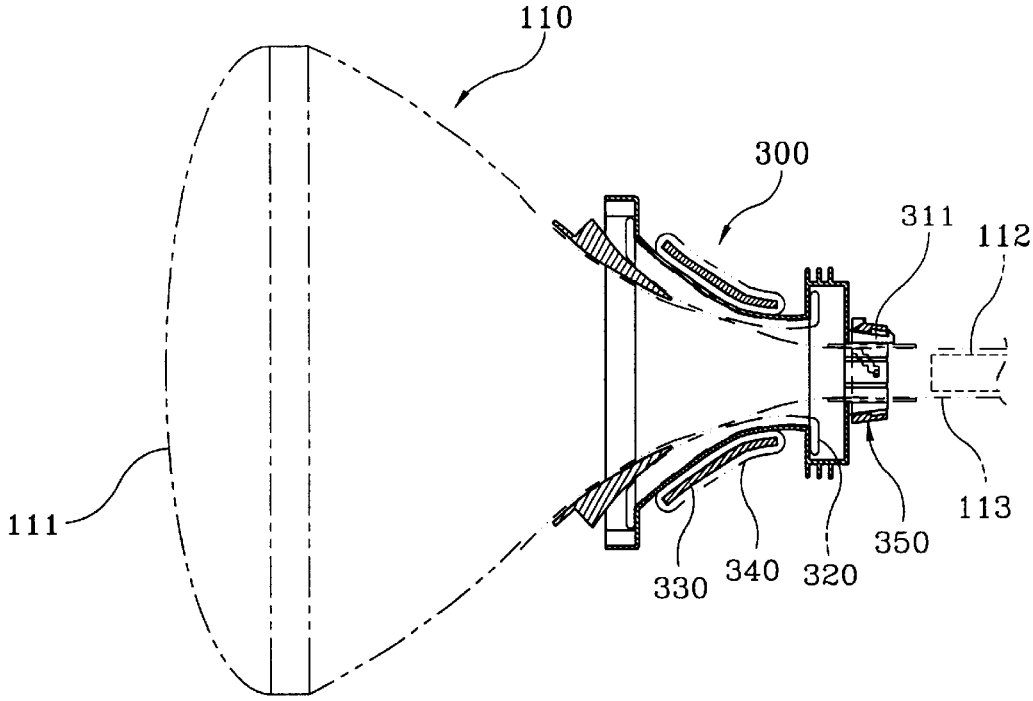
FIG. 15 is a side view of a cathode ray tube having a deflection yoke according to the present invention.
Figure 16:
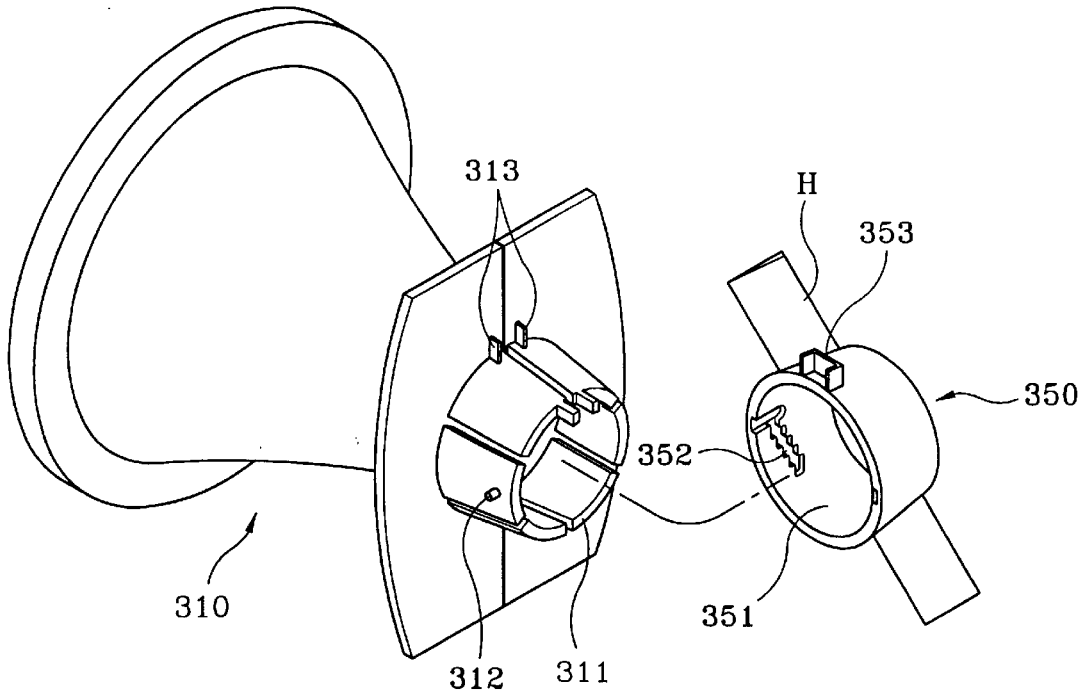
FIGS. 16 through 18 are perspective views illustrating various embodiments of first and second locking means, in the deflection yoke of the present invention.

As shown in FIG. 15, a deflection yoke 300 of the present embodiment is mounted to a cathode ray tube 110 and functions to deflect electron beams.

The cathode ray tube 110 has a screen 111 on which a fluorescent layer is applied, and an electron gun section 113 in which electron guns 112 are mounted. The deflection yoke 300 is positioned adjacent to the electron gun section 113 in which the electron guns 112 are mounted, and functions to precisely deflect the electron beams emitted from the electron guns 112 toward the fluorescent layer applied on the screen 111.

The deflection yoke 300 includes a coil separator 310 which has a neck part 311. The neck part 311 is fitted around the electron gun section 113 of the cathode ray tube 110 and has first locking means arranged on a circumferential outer surface thereof.

A horizontal deflecting coil 320 is disposed on a circumferential inner surface of the coil separator 310 to form a horizontally deflecting magnetic field, and a vertical deflecting coil 340 is disposed together with a ferrite core 330 on a circumferential outer surface of the coil separator 310 to form a vertically deflecting magnetic field.

Clamping means 350 is fitted around the neck part 311 of the coil separator 310. The clamping means 350 has second locking means which cooperates with the first locking means to clamp the deflection yoke 300 to the electron gun section 113 of the cathode ray tube 110.

The second locking means of the clamping means 350 has a closed-loop shaped configuration which surrounds the circumferential outer surface of the neck part 311 having the first locking means.

The first and second locking means are locked with each other while being rotated about an axis which is perpendicular to a plane of the screen 111 of the cathode ray tube 110.

As the first locking means, a guide projection 312 is projectedly formed on the circumferential outer surface of the neck part 311. The guide projection 312 has a predetermined length.

As the second locking means, a squeezing surface 351 is defined in a circumferential inner surface of the clamping means 350. The squeezing surface 351 has a diameter which is not greater than an outer diameter of the neck part 311 of the coil separator 310. Also, as the second locking means, a guide rail 352 is formed in the squeezing surface 351 such that it extends slantingly within a predetermined range in a direction in which the clamping means 350 is fitted around the neck part 311 of the coil separator 310.

Figure 19:
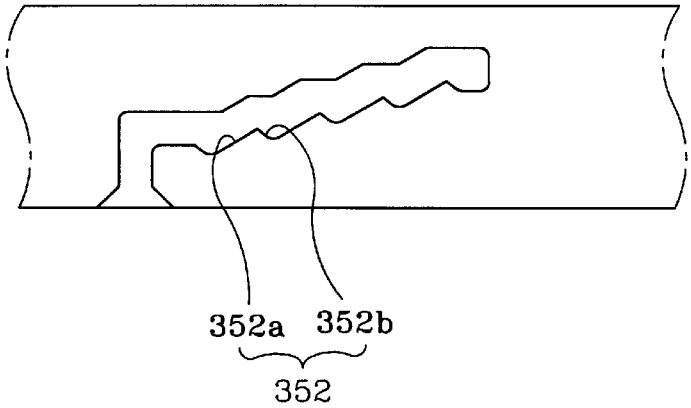
FIG. 19 is an enlarged view of clamping means which uses a guide rail as the second locking means, in the deflection yoke of the present invention.

When viewing a shape of the guide rail 352, as shown in FIG. 19, the guide rail 352 has a plurality of inclined surfaces 352*a* on which the guide projection 312 constituting the first locking means can be guided while sliding thereon, and a plurality of depressions 352*b* each of which is defined between two adjoining inclined surfaces 352*a* and into which the guide projection 312 can be selectively engaged.

Figure 17:
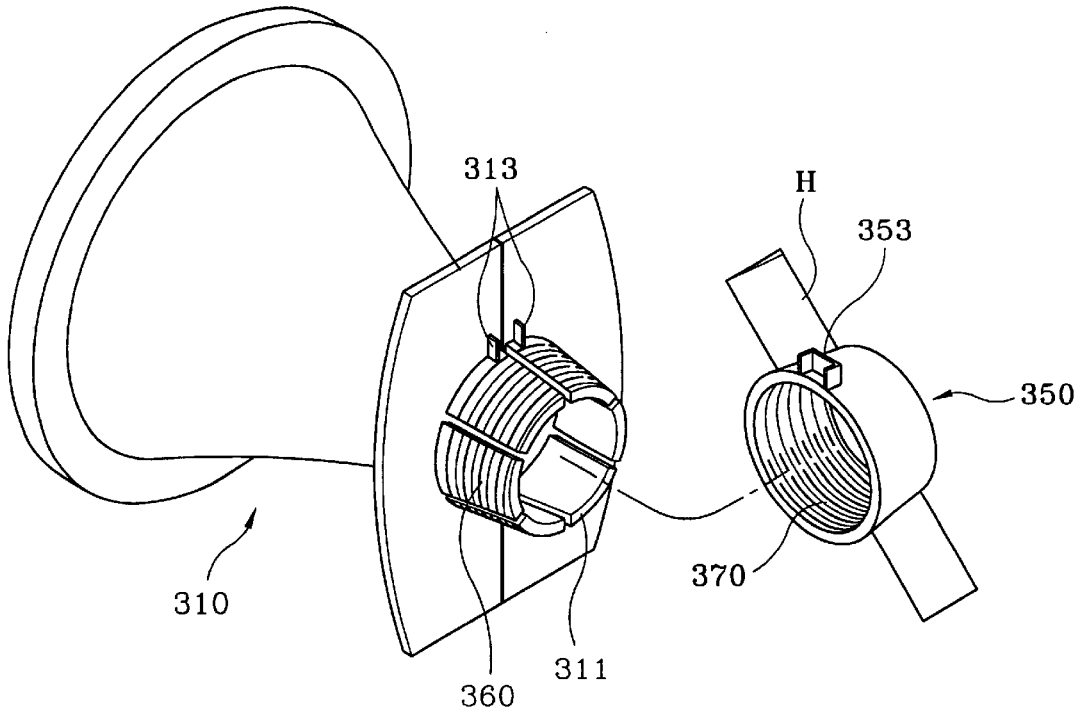

On the other hand, as shown in FIG. 17, an externally threaded portion 360 formed on the circumferential outer surface of the neck part 311 of the coil separator 310 can be used as the first locking means.

According to this, the second locking means consists of the squeezing surface 351 defined in the circumferential inner surface of the clamping means 350 and having the diameter which is not greater than the outer diameter of the neck part 311 of the coil separator 310, and an internally threaded portion 370 formed on the squeezing surface 351.

Figure 18:
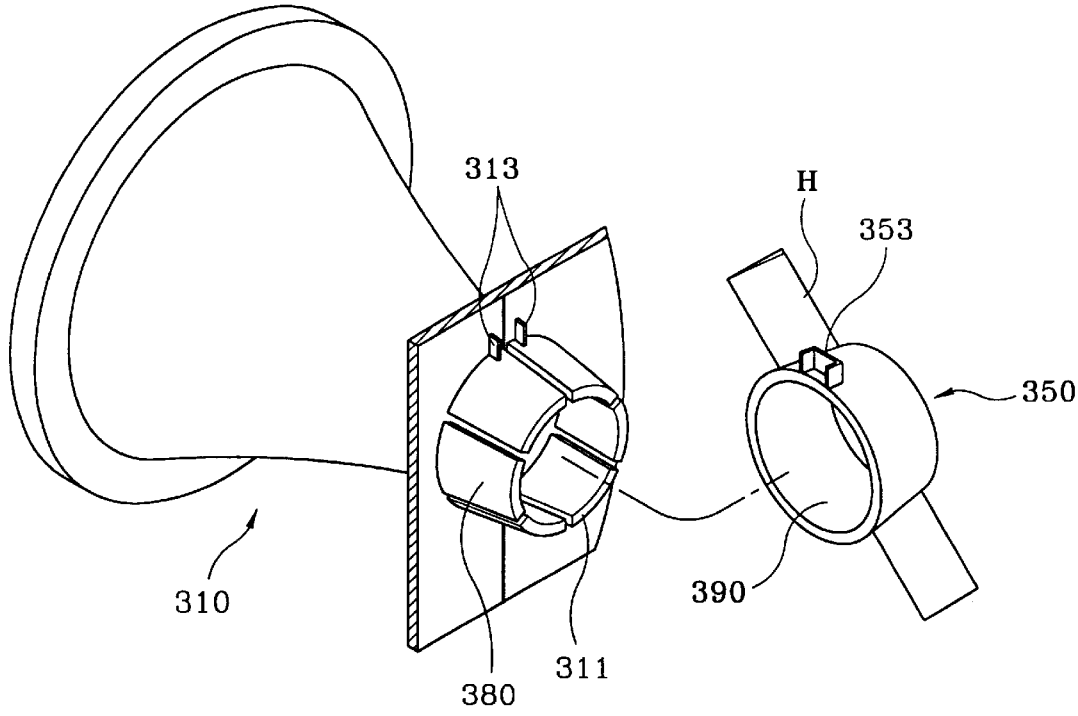

Referring to FIG. 18, as the first locking means, a first tapered surface 380 can be formed on the circumferential outer surface of the neck part 311 of the coil separator 310. The first tapered surface 380 is tapered in an axial direction, and has a predetermined taper. Also, as the second locking means, a second tapered surface 390 can be formed on the circumferential inner surface of the clamping means 350. The second tapered surface 390 has a diameter which is not greater than the outer diameter of the neck part 311 of the coil separator 310.

In the meanwhile, once the deflection yoke 300 is clamped to the electron gun section 113 of the cathode ray tube 110 by the clamping means 350, it is preferred that a position of the deflection yoke 300 not be changed by an outside shock.

For this, it is desirable that a pair of brackets 313 are provided at a front end of the neck part 311 of the coil separator 310 constituting the deflection yoke 300 such that they are protruded in a radial direction from the circumferential outer surface of the neck part 311, and that a cover member 353 is provided at a front end of the clamping means 350. The pair of brackets 313 and the cover member 353 cooperate with each other for defining an adhesive receiving space therebetween when clamping of the deflection yoke 300 by the clamping means 350 is completed. Then, adhesive is introduced into the adhesive receiving space to increase a clamping force.

At this time, although it is explained that only the pair of brackets 313 and the cover member 353 are provided, it is preferred that at least two pairs of brackets and at least two cover members are provided to enhance the clamping force.

Also, as the clamping means 350 is fitted around the neck part 311 of the coil separator 310 while being rotated, a handle H is secured to the circumferential outer surface of the clamping means 350 to ease the rotation of the clamping means 350.

Hereinafter, clamping operations of the display device constructed as mentioned above, for clamping the deflection yoke 300 to the electron gun section 113 of the cathode ray tube 110, will be described in detail.

First, the neck part 311 of the coil separator 310 constituting the deflection yoke 300 is fitted around the electron gun section 113 of the cathode ray tube 110. Then, the clamping means 350 is fitted around the neck part 311 of the coil separator 310.

Figure 20A:
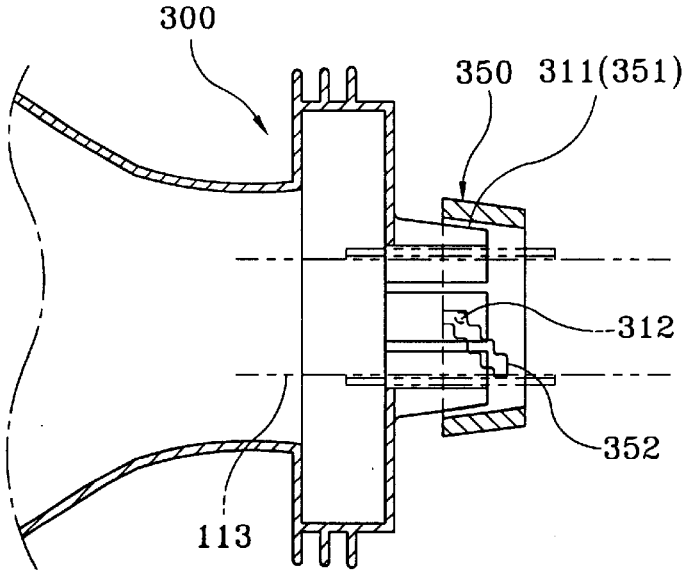
FIGS. 20*a* through 20*c* are cross-sectional views illustrating clamping operations when a guide projection and the guide rail are used as the first and second locking means, in the deflection yoke of the present invention.

At this time, as can be seen from FIG. 20*a*, even if the clamping means 350 is fitted around the neck part 311 of the coil separator 310, the deflection yoke 300 may be rotated or moved on a circumferential outer surface of the electron gun section 113 of the cathode ray tube 110.

Figure 20B:
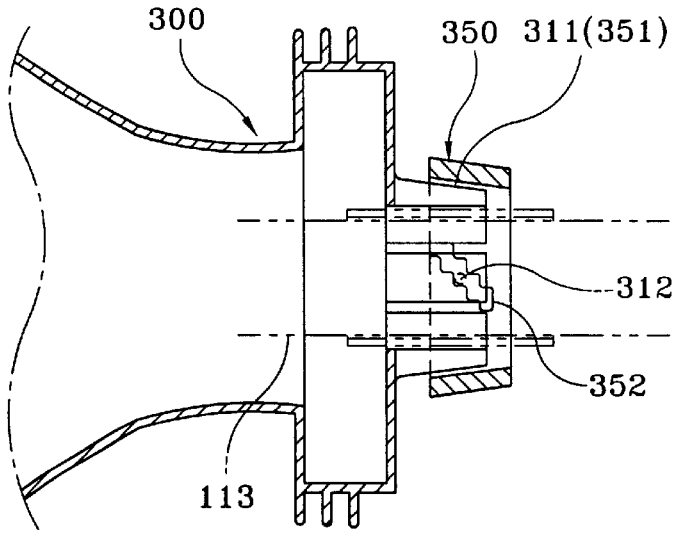

In this state by rotating the clamping means 350 in a clockwise direction or a counter-clockwise direction while grasping the handle H secured to the circumferential outer surface of the clamping means 350, the second locking means arranged on the circumferential inner surface of the clamping means 350 cooperates with the first locking means arranged on the neck part 311 of the coil separator 310, and the clamping means 350 is moved toward the cathode ray tube 110 by a certain distance while squeezing the neck part 311 of the coil separator 310 against the electron gun section 113 of the cathode ray tube 110, to decrease the diameter of the neck part 311 to some extent, as shown in FIG. 20*b*.

In other words, in one embodiment of the present invention, the guide projection 312 constituting the first locking means is moved by a certain distance along the plurality of inclined surfaces 352*a*. In another embodiment of the present invention, the internally threaded portion 370 formed on the circumferential inner surface of the clamping means 350 and constituting the second locking means is moved by a certain distance along the externally threaded portion 360 formed on the neck part 311 of the coil separator 310 and constituting the first locking means.

Also, in still another embodiment of the present invention, the second tapered surface 390 formed on the circumferential inner surface of the clamping means 350 and constituting the second locking means is moved by a certain distance along the first tapered surface 380 formed on the circumferential outer surface of the neck part 311 of the coil separator 310 and constituting the first locking means.

In this state, the deflection yoke 300 is maintained in a pre-squeezed condition in which it can still be rotated or moved on the electron gun section 113 of the cathode ray tube 110 by applying a slight force.

Accordingly, it is possible to stably adjust deflections of the electron beams.

Figure 20C:
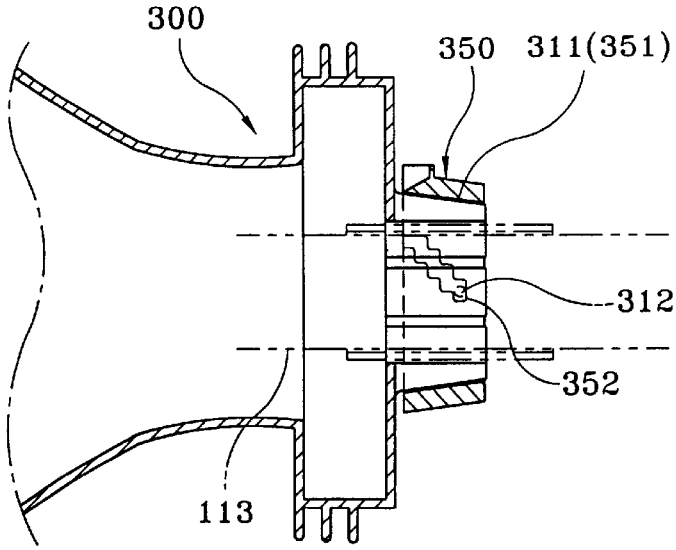

After the deflections of the electron beams are stably adjusted, if the clamping means 350 is further rotated, as best shown in FIG. 20*c*, the clamping means 350 is further moved toward the screen 111 of the cathode ray tube 110, and the second locking means provided to the clamping means 350 squeezes the neck part 311 of the coil separator 310 against the electron gun section 113 of the cathode ray tube 110, whereby the deflection yoke 300 is securely clamped to the electron gun section 113 of the cathode ray tube 110.

Also, at this time, the pair of brackets 313 secured to the front end of the neck part 311 of the coil separator 310 and the cover member 353 secured to the front end of the clamping means 350 are mated with each other to define the adhesive receiving space.

Accordingly, by introducing adhesive into the adhesive receiving space, the clamping force for clamping the deflection yoke 300 to the electron gun section 113 of the cathode ray tube 110 is elevated. Therefore, the position of the deflection yoke 300 is not changed by the outside shock.

As described above, according to the present invention, a deflection yoke for deflecting electron beams emitted from electron guns toward a screen of a cathode ray tube can be securely and stably clamped to an electron gun section of the cathode ray tube by a clamping means.

Hence, deterioration of a picture can be prevented due to stable deflections of electron beams, and reliability of a display device can be improved.

Also, since a screw or a special tool for fixing a deflection yoke is not required, the number of working operations is reduced, and since the deflection yoke is clamped through rotation of a clamping means, working efficiency is enhanced.

Yet still another embodiment of the present invention will be described with reference to FIGS. 21 through 26.

Figure 21:
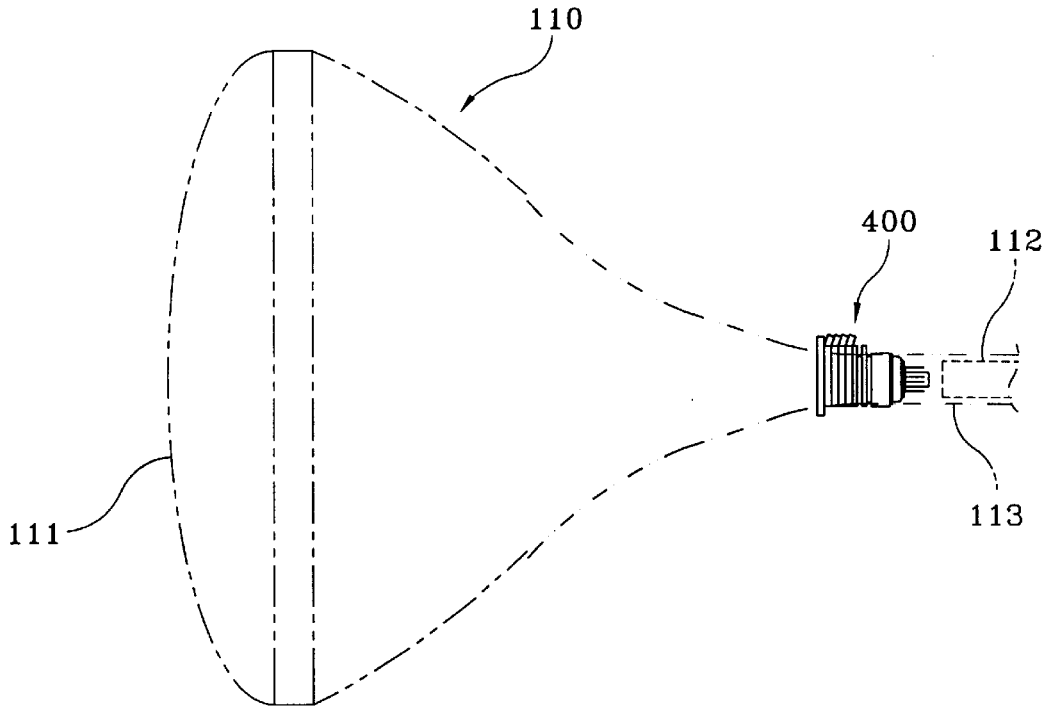
FIG. 21 is a side view of a cathode ray tube having a convergence yoke according to the present invention.
Figure 22:
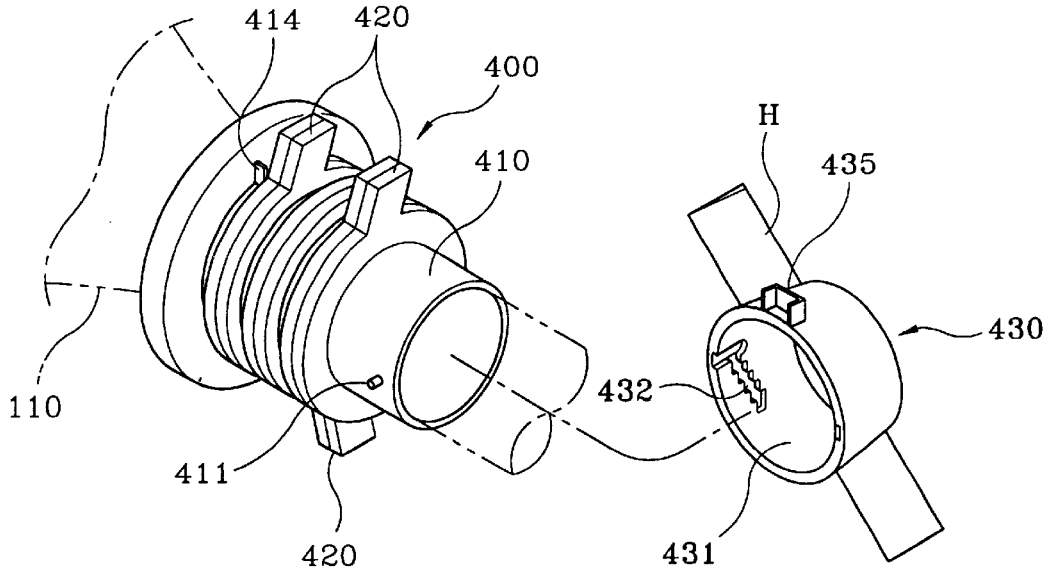
FIGS. 22 through 24 are perspective views illustrating various embodiments of first and second locking means, in the convergence yoke of the present invention.

As shown in FIG. 21, a convergence yoke 400 is mounted to a cathode ray tube 110, and functions to perform a positive convergence adjustment of electron beams emitted from electron guns.

The cathode ray tube 110 has a screen 111 on which a fluorescent layer is applied, and an electron gun section 113 in which the electron guns 112 are mounted. The convergence yoke 400 is positioned adjacent to the electron gun section 113 in which the electron guns 112 are mounted, and functions to perform the positive convergence adjustment for precisely positioning the electron beams emitted from the electron guns 112 on a center of the screen 111.

The convergence yoke 400 includes a cylindrical body 410 fitted around the electron gun section 113 of the cathode ray tube 110 and having first locking means, and a plurality of pole pieces 420 arranged on a circumferential outer surface of the cylindrical body 410 such that two adjoining pole pieces 420 are spaced from each other by a predetermined distance.

The first locking means is defined on the circumferential outer surface of the cylindrical body 410 of the convergence yoke 400.

Clamping means 430 is fitted around the circumferential outer surface of the cylindrical body 410. The clamping means 430 has second locking means which cooperates with the first locking means to clamp the convergence yoke 400 to the electron gun section 113 of the cathode ray tube 110.

The second locking means of the clamping means 430 has a closed-loop shaped configuration which surrounds the circumferential outer surface of the cylindrical body 410 having the first locking means.

The first and second locking means are locked with each other while being rotated about an axis which is perpendicular to a plane of the screen 111 of the cathode ray tube 110.

As the first locking means, a guide projection 411 is projectedly formed on the circumferential outer surface of the cylindrical body 410 of the convergence yoke 400. The guide projection 411 has a predetermined length.

As the second locking means, a squeezing surface 431 is defined in a circumferential inner surface of the clamping means 430. The squeezing surface 431 has a diameter which is not greater than an outer diameter of the cylindrical body 410. Also, as the second locking means, a guide rail 432 is formed in the squeezing surface 431 such that it extends slantingly within a predetermined range in a direction in which the clamping means 430 is fitted around the cylindrical body 410.

Figure 25:
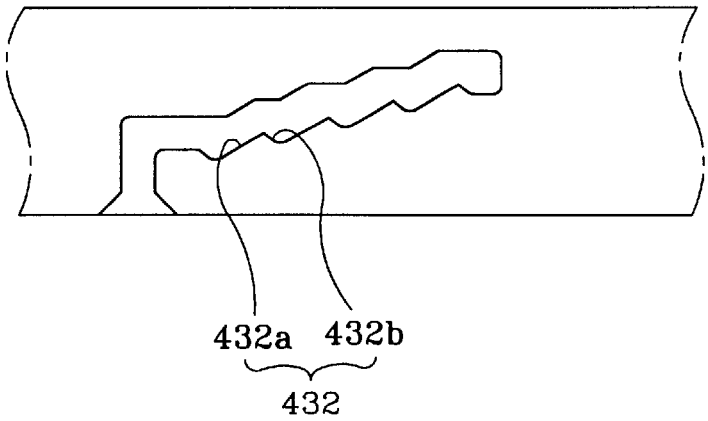
FIG. 25 is an enlarged view of clamping means which uses a guide rail as the second locking means, in the convergence yoke of the present invention.

When viewing a shape of the guide rail 432, as shown in FIG. 25, the guide rail 432 has a plurality of inclined surfaces 432*a* on which the guide projection 411 constituting the first locking means can be guided while sliding thereon, and a plurality of depressions 432*b* each of which is defined between two adjoining inclined surfaces 432*a* and into which the guide projection 411 can be selectively engaged.

Figure 23:
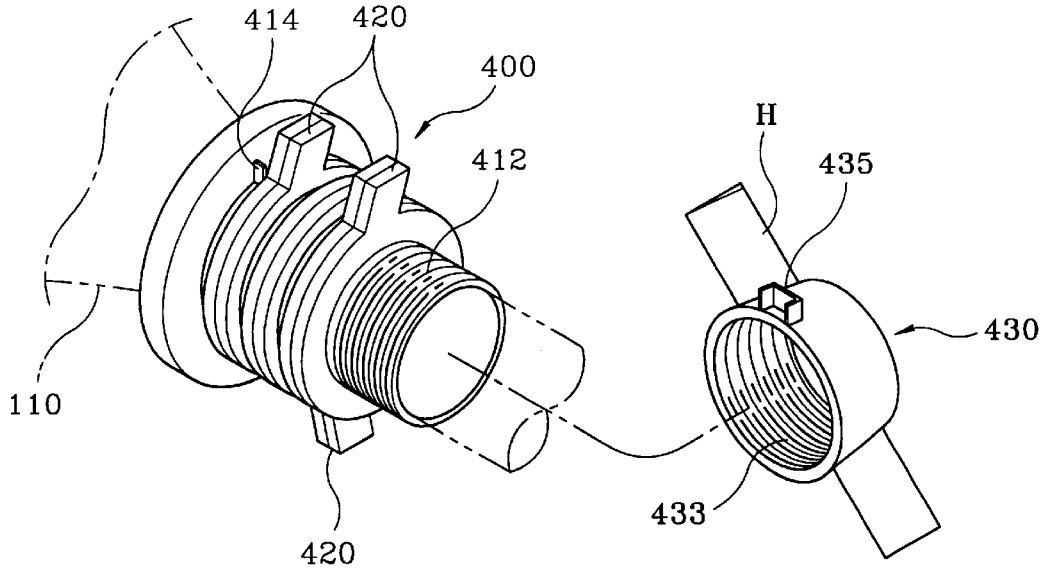

On the other hand, as shown in FIG. 23, an externally threaded portion 412 formed on the circumferential outer surface of the cylindrical body 410 can be used as the first locking means.

According to this, the second locking means consists of the squeezing surface 431 defined in the circumferential inner surface of the clamping means 430 and having the diameter which is not greater than the outer diameter of the cylindrical body 410, and an internally threaded portion 433 formed on the squeezing surface 431.

Figure 24:
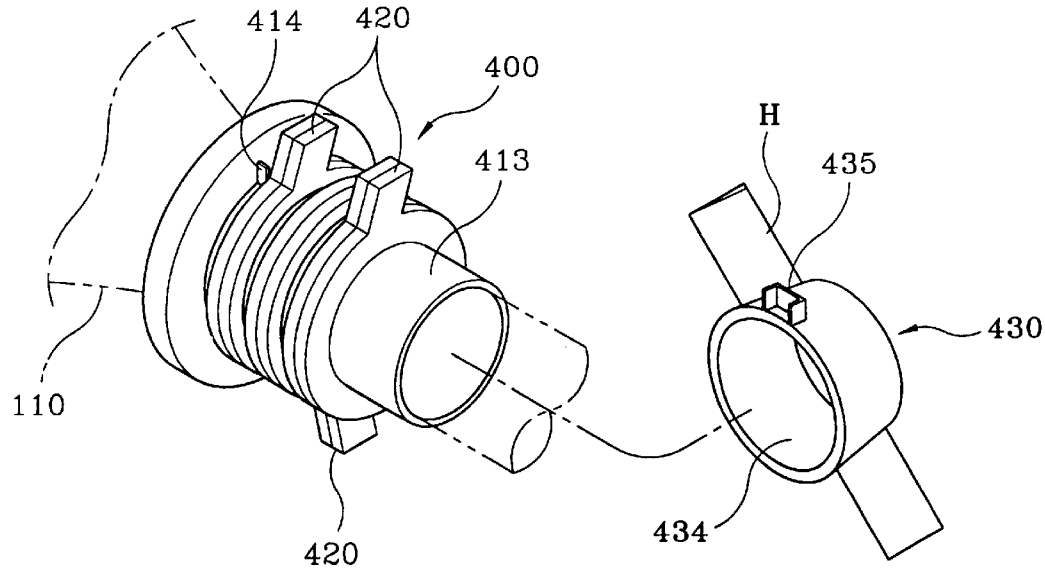

Referring to FIG. 24, as the first locking means, a first tapered surface 413 can be formed on the circumferential outer surface of cylindrical body 410. The first tapered surface 413 is tapered in an axial direction, and has a predetermined taper. Also, as the second locking means, a second tapered surface 434 can be formed on the circumferential inner surface of the clamping means 430. The second tapered surface 434 has a diameter which is not greater than the outer diameter of the cylindrical body 410.

In the meanwhile, once the convergence yoke 400 is clamped to the electron gun section 113 of the cathode ray tube 110 by the clamping means 430, it is preferred that a position of the convergence yoke 400 not be changed by an outside shock.

For this, it is desirable that a pair of brackets 414 are provided at a front end of the cylindrical body 410 constituting the convergence yoke 400 such that they are protruded in a radial direction from the circumferential outer surface of the cylindrical body 410, and that a cover member 435 is provided at a front end of the clamping means 430. The pair of brackets 414 and the cover member 435 cooperate with each other for defining an adhesive receiving space therebetween when clamping of the convergence yoke 400 by the clamping means 430 is completed. Then, adhesive is introduced into the adhesive receiving space to increase a clamping force.

At this time, although it is explained that only the pair of brackets 414 and the cover member 435 are provided, it is preferred that at least two pairs of brackets and at least two cover members are provided to enhance the clamping force.

Also, as the clamping means 430 is fitted around the cylindrical body 410 while being rotated, a handle H is secured to the circumferential outer surface of the clamping means 430 to ease the rotation of the clamping means 430.

Hereinafter, clamping operations of the display device constructed as mentioned above, for clamping the convergence yoke 400 to the electron gun section 113 of the cathode ray tube 110, will be described in detail.

First, the cylindrical body 410 constituting the convergence yoke 400 is fitted around the electron gun section 113 of the cathode ray tube 110. Then, the clamping means 430 is fitted around the cylindrical body 410.

Figure 26A:
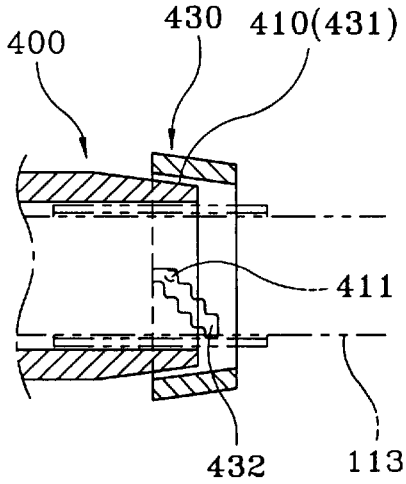
FIGS. 26*a* through 26*c* are cross-sectional views illustrating clamping operations when a guide projection and the guide rail are used as the first and second locking means, in the convergence yoke of the present invention.

At this time, as can be seen from FIG. 26*a*, even if the clamping means 430 is fitted around the cylindrical body 410, the convergence yoke 400 may be rotated or moved on a circumferential outer surface of the electron gun section 113 of the cathode ray tube 110.

Figure 26B:
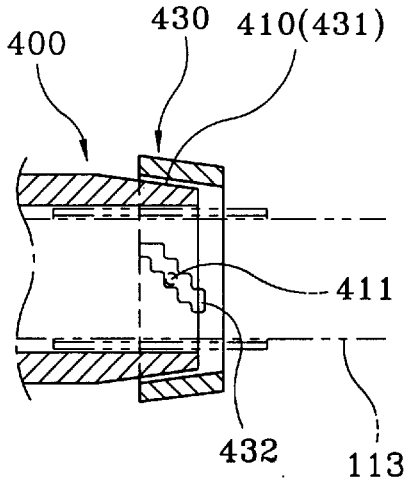

In this state, by rotating the clamping means 430 in a clockwise direction or a counter-clockwise direction while grasping the handle H secured to the circumferential outer surface of the clamping means 430, the second locking means arranged on the circumferential inner surface of the clamping means 430 cooperates with the first locking means arranged on the cylindrical body 410, and the clamping means 430 is moved toward the cathode ray tube 110 by a certain distance while squeezing the cylindrical body 410 against the electron gun section 113 of the cathode ray tube 110, to decrease the diameter of the cylindrical body 410 to some extent, as shown in FIG. 26*b*.

In other words, in one embodiment of the present invention, the guide projection 411 constituting the first locking means is moved by a certain distance along the plurality of inclined surfaces 432*a* of the guide rail 432. In another embodiment of the present invention, the internally threaded portion 433 formed on the circumferential inner surface of the clamping means 430 and constituting the second locking means is moved by a certain distance along the externally threaded portion 412 formed on the circumferential outer surface of the cylindrical body 410 and constituting the first locking means.

Also, in still another embodiment of the present invention, the second tapered surface 434 formed on the circumferential inner surface of the clamping means 430 and constituting the second locking means is moved by a certain distance along the first tapered surface 413 formed on the circumferential outer surface of the cylindrical body 410 and constituting the first locking means.

In this state, the convergence yoke 400 is maintained in a pre-squeezed condition in which it can still be rotated or moved on the electron gun section 113 of the cathode ray tube 110 by applying a slight force.

Accordingly, it is possible to stably adjust deflections of the electron beams.

Figure 26C:
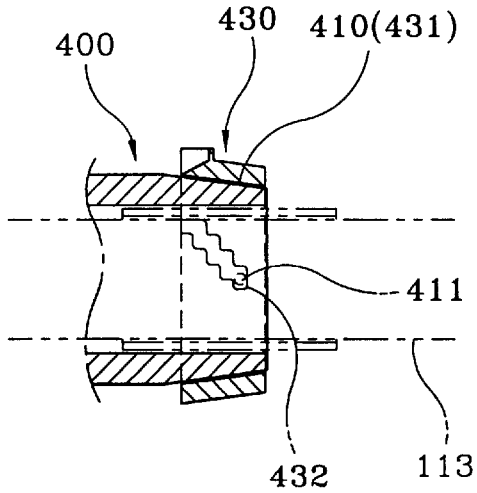

After the deflections of the electron beams are stably adjusted, if the clamping means 430 is further rotated, as best shown in FIG. 26*c*, the clamping means 430 is further moved toward the screen 111 of the cathode ray tube 110, and the second locking means provided to the clamping means 430 squeezes the cylindrical body 410 against the electron gun section 113 of the cathode ray tube 110, whereby the convergence yoke 400 is securely clamped to the electron gun section 113 of the cathode ray tube 110.

Also, at this time, the pair of brackets 414 secured to the front end of the cylindrical body 410 and the cover member 435 secured to the front end of the clamping means 430 are mated with each other to define the adhesive receiving space.

Accordingly, by introducing adhesive into the adhesive receiving space, the clamping force for clamping the convergence yoke 400 to the electron gun section 113 of the cathode ray tube 110 is elevated. Therefore, the position of the convergence yoke 400 is not changed by the outside shock.

As described above, according to the present invention, a convergence yoke for performing a positive convergence adjustment of electron beams emitted from electron guns can be securely and stably clamped to an electron gun section of a cathode ray tube by a clamping means.

Hence, deterioration of a picture can be prevented, and reliability of a display device can be improved.

Also, since a screw or a special tool for fixing a convergence yoke is not required, the number of working operations is reduced, and since the convergence yoke is clamped through rotation of a clamping means, working efficiency is enhanced.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A display device comprising:

a cathode ray tube having a screen on which a fluorescent layer is applied and an electron gun section in which electron guns are mounted;

a deflection yoke including a coil separator having a neck part which is fitted around the electron gun section of the cathode ray tube, and horizontal and vertical deflecting coils which are disposed on circumferential inner and outer surfaces of the coil separator, respectively;

first locking means arranged on a circumferential outer surface of the neck part of the coil separator; and clamping means fitted around the neck part of the coil separator and having second locking means, the second locking means having a closed-loop shaped configuration which surrounds the circumferential outer surface of the neck part and cooperating with the first locking means for locking the deflection yoke to the electron gun section of the cathode ray tube.

2. The display device as claimed in claim 1, wherein the first locking means comprises a guide projection which is projectedly formed on the circumferential outer surface of the neck part of the coil separator to have a predetermined length.

3. The display device as claimed in claim 1, wherein the second locking means comprises a circumferential squeezing surface defined in a circumferential inner surface of the clamping means and having a diameter which is not greater than an outer diameter of the neck part of the coil separator, and a guide rail formed in the circumferential squeezing surface such that it extends slantingly from one end thereof toward the other end thereof in a direction in which the clamping means is fitted around the neck part of the coil separator.

4. The display device as claimed in claim 3, wherein the guide rail has a plurality of inclined surfaces on which the first locking means can be guided while sliding, and a plurality of depressions each of which is defined between two adjoining inclined surfaces and into which the first locking means can be engaged.

5. The display device as claimed in claim 1, wherein the first and second locking means are locked with each other while being rotated about an axis which is perpendicular to a plane of the screen of the cathode ray tube.

6. The display device as claimed in claim 1, wherein the first locking means comprises an externally threaded portion formed on the circumferential outer surface of the neck part of the coil separator.

7. The display device as claimed in claim 1, wherein the second locking means comprises the circumferential squeezing surface defined in the circumferential inner surface of the clamping means and having the diameter which is not greater than the outer diameter of the neck part of the coil separator, and an internally threaded portion formed on the circumferential squeezing surface.

8. The display device as claimed in claim 1, wherein the first locking means comprises a first circumferential tapered surface formed on the circumferential outer surface of the neck part of the coil separator and tapered in an axial direction, the first circumferential tapered surface having a predetermined taper.

9. The display device as claimed in claim 1, wherein the second locking means comprises a second circumferential tapered surface formed on the circumferential inner surface of the clamping means and having a diameter which is not greater than the outer diameter of the neck part of the coil separator.

10. The display device as claimed in claim 1, wherein at least one bracket is provided at one end of the neck part of the coil separator such that it is protruded in a radial direction from the circumferential outer surface of the neck part, and at least one cover member is provided at one end of the clamping means, the bracket and the cover member cooperating with each other for defining an adhesive receiving space therebetween when clamping of the deflection yoke by the clamping means is completed.

11. The display device as claimed in claim 1, wherein a handle is secured to the circumferential outer surface of the clamping means to ease rotation of the clamping means.

12. The display device as claimed in claim 1, and further comprising:

a convergence yoke having a cylindrical body which is fitted around the electron gun section of the cathode ray tube, and a plurality of pole pieces arranged on a circumferential outer surface of the cylindrical body such that two adjoining pole pieces are spaced from each other by a predetermined distance;

first locking means arranged on the circumferential outer surface of the cylindrical body of the convergence yoke; and clamping means having a second locking means, the second locking means having a closed-loop shaped configuration which surrounds the circumferential outer surface of the cylindrical body and cooperating with the first locking means for locking the convergence yoke to the electron gun section of the cathode ray tube.

13. A deflection yoke coupled to an electron gun section of a cathode ray tube having a screen on which a fluorescent layer is applied, for deflecting electron beams emitted from electron guns mounted in the electron gun section toward the fluorescent layer of the screen, the deflection yoke comprising:

a coil separator having a neck part which is fitted around the electron gun section of the cathode ray tube and has first locking means arranged on a circumferential outer surface thereof;

a horizontal deflecting coil disposed on a circumferential inner surface of the coil separator for forming a horizontally deflecting magnetic field;

a vertical deflecting coil disposed together with a ferrite core on a circumferential outer surface of the coil separator for forming a vertically deflecting magnetic field; and clamping means fitted around the neck part of the coil separator and having second locking means, the second locking means having a closed-loop shaped configuration which surrounds the circumferential outer surface of the neck part and cooperating with the first locking means for locking the coil separator to the electron gun section of the cathode ray tube.

14. The deflection yoke as claimed in claim 13, wherein the first locking means comprises a guide projection which is projectedly formed on the circumferential outer surface of the neck part of the coil separator to have a predetermined length.

15. The deflection yoke as claimed in claim 13, wherein the second locking means comprises a circumferential squeezing surface defined in a circumferential inner surface of the clamping means and having a diameter which is not greater than an outer diameter of the neck part of the coil separator, and a guide rail formed in the circumferential squeezing surface such that it extends slantingly from one end thereof toward the other end thereof in a direction in which the clamping means is fitted around the neck part of the coil separator.

16. The deflection yoke as claimed in claim 15, wherein the guide rail has a plurality of inclined surfaces on which the first locking means can be guided while sliding, and a plurality of depressions each of which is defined between two adjoining inclined surfaces and into which the first locking means can be engaged.

17. The deflection yoke as claimed in claim 13, wherein the first and second locking means are locked with each other while being rotated about an axis which is perpendicular to a plane of the screen of the cathode ray tube.

18. The deflection yoke as claimed in claim 13, wherein the first locking means comprises an externally threaded portion formed on the circumferential outer surface of the neck part of the coil separator.

19. The deflection yoke as claimed in claim 13, wherein the second locking means comprises the circumferential squeezing surface defined in the circumferential inner surface of the clamping means and having the diameter which is not greater than the outer diameter of the neck part of the coil separator, and an internally threaded portion formed on the circumferential squeezing surface.

20. The deflection yoke as claimed in claim 13, wherein the first locking means comprises a first circumferential tapered surface formed on the circumferential outer surface of the neck part of the coil separator and tapered in an axial direction, the first circumferential tapered surface having a predetermined taper.

21. The deflection yoke as claimed in claim 13, wherein the second locking means comprises a second circumferential tapered surface formed on the circumferential inner surface of the clamping means and having a diameter which is not greater than the outer diameter of the neck part of the coil separator.

22. The deflection yoke as claimed in claim 13, wherein at least one bracket is provided at one end of the neck part of the coil separator such that it is protruded in a radial direction from the circumferential outer surface of the neck part, and at least one cover member is provided at one end of the clamping means, the bracket and the cover member cooperating with each other for defining an adhesive receiving space therebetween when clamping of the coil separator by the clamping means is completed.

23. The deflection yoke as claimed in claim 13, wherein a handle is secured to the circumferential outer surface of the clamping means to ease rotation of the clamping means.

* * * * *